US006042335A

United States Patent [19]

Amr

[11] Patent Number: 6,042,335

[45] Date of Patent: Mar. 28, 2000

[54] CENTRIFUGAL FLOW FAN AND FAN/ ORIFICE ASSEMBLY

[75] Inventor: Yehia M. Amr, Manlius, N.Y.

[73] Assignee: Carrier Corporation, Farmington, Conn.

[21] Appl. No.: 09/072,109

[22] Filed: May 4, 1998

[51] Int. Cl.[7] ..... F04D 29/44; F04D 29/66

[52] U.S. Cl. ..... 415/208.1; 415/206; 415/173.1; 415/173.6; 415/188; 415/211.1; 415/223; 416/186 R; 416/189; 416/192; 416/195; 416/238; 416/223 B

[58] Field of Search ..... 415/208.1, 211.1, 415/188, 223, 173.1, 173.6, 206; 416/186 R, 189, 192, 195, 238, 223 B, DIG. 2

[56] References Cited

U.S. PATENT DOCUMENTS

| | | | |
|---|---|---|---|
| 3,692,428 | 9/1972 | Bubb et al. . | |
| 3,846,043 | 11/1974 | Wolbring et al. . | |
| 4,231,706 | 11/1980 | Ueda et al. | 416/186 R |
| 4,521,154 | 6/1985 | Corbett . | |
| 4,569,632 | 2/1986 | Gray, III | 416/189 |
| 4,647,271 | 3/1987 | Nagai et al. . | |
| 4,828,456 | 5/1989 | Bodzian et al. | 415/211.1 |
| 5,171,128 | 12/1992 | Williamson et al. . | |
| 5,215,437 | 6/1993 | EtVelde et al. . | |
| 5,273,400 | 12/1993 | Amr | 416/189 |
| 5,478,201 | 12/1995 | Amr | 415/206 |
| 5,478,205 | 12/1995 | Chou et al. . | |
| 5,624,234 | 4/1997 | Neely et al. | 416/238 |
| 5,803,721 | 9/1998 | Lee | 417/423.14 |

FOREIGN PATENT DOCUMENTS

| | | |
|---|---|---|
| 7293494 | 11/1995 | Japan . |
| 534486 | 3/1941 | United Kingdom . |

*Primary Examiner*—Edward K. Look
*Assistant Examiner*—Matthew T. Shanley
*Attorney, Agent, or Firm*—Wall Marjama Bilinski & Burr

[57] ABSTRACT

A centrifugal fan including a fan hub lying generally in a plane normal to the axis of fan rotation and having a central opening for receiving a motor housing, and a plurality of fan blades of substantially identical construction spaced circumferentially evenly around the fan hub and extending away from the fan hub in a direction parallel to the axis of fan rotation. Each fan blade includes a leading edge at its innermost radial periphery, and the leading edge, at least at the axially upper one-half section thereof, is convexly curved in the shape of a quarter ellipse having a major axis, Mg, substantially parallel to the axis of fan rotation and a minor axis, mh, normal to the major axis Mg. The fan also includes a continuous shroud joined to each fan blade at an axially upper section of the radially outer portion thereof and the shroud is concave in cross-section. The fan orifice used in conjunction with the fan has an entry portion that is convex in cross-section and is in the form of a surface produced by rotating a planar line about a coplanar axis of generation that is coincident with the axis of rotation of the fan, the planar line being a generally quarter segment of an ellipse having a major axis, Ma, substantially parallel to the axis of generation and a minor axis, mb, normal to the major axis Ma.

10 Claims, 3 Drawing Sheets

CENTRIFUGAL FLOW FAN AND FAN/ ORIFICE ASSEMBLY

BACKGROUND OF THE INVENTION

The present invention relates to a centrifugal flow fan and fan/orifice assembly for moving air. In particular, the invention relates to a high efficiency centrifugal flow fan and fan/orifice assembly that provide improved fan performance at high static pressures.

Centrifugal flow fans are used to change the movement of air from a direction arranged generally parallel to the axis of fan rotation to a direction arranged generally radial (perpendicular) to the axis of fan rotation. FIG. 5 is a diagram showing an example of a centrifugal fan and orifice assembly used for this purpose. The orifice includes a bell-shaped inlet bulkhead 110 defining an inlet orifice 111 for introducing air into the fan. A centrifugal fan 112 is provided downstream of the inlet and is driven by a motor 120 to draw air into the inlet orifice in a direction generally parallel to the axis of fan rotation and force the air radially outwardly from the blades 113 of the fan. The fan includes a shroud 114 to help direct the air centrifugally out of the fan body.

In the assembly depicted in FIG. 5, the structure of the fan blades is such that the diameter, d, of inlet orifice 111 is usually less than 70% the diameter, D, of fan 112. As a result, motor 120 blocks a significant portion of inlet orifice 111, causing a substantial pressure drop through the inlet orifice. The fan must work harder to compensate for this pressure drop. While the pressure drop through the inlet opening could be reduced by reducing the size of the motor used to drive the fan, this would in most cases limit motor power and speed, and thus air flow.

Additionally, the leading edge 113L of each fan blade is radially spaced from the outer surface of motor 120 to allow air to enter the body of the fan blades without impediment. However, this degrades the overall performance of the fan, since the radial spacing at the base region of the fan blades is essentially wasted space. That is, the air entering the fan is already on the body of the blades and is being redirected centrifugally by the time it reaches the base region of the blades. Accordingly, the radial spacing at the base region of the fan blades does not greatly contribute to the entry of air into the body of the fan blades, and the absence of fan blade structure in this region takes away from the ability of the fan to push the air centrifugally out of the fan body.

It would be desirable to reduce the pressure drop through the inlet orifice due to the presence of the motor housing, and also increase the overall efficiency of the fan without impeding the flow of air into the body of the fan blades.

SUMMARY OF THE INVENTION

It is an object of the invention to provide a centrifugal flow fan and fan/orifice assembly that provide decreased pressure drop through the inlet orifice of the assembly, and also improve the overall efficiency of the fan without impeding the flow of air into the body of the fan blades.

The centrifugal flow fan and fan/orifice assembly in accordance with the invention achieve both of the objects stated above by redesigning the structure of the fan (instead of the motor) and selecting a specific cooperative structure for the fan orifice. The fan in accordance with the present invention includes a fan hub lying generally in a plane normal to the axis of fan rotation and having a central opening for receiving a motor housing, and a plurality of fan blades of substantially identical construction spaced circumferentially evenly around the fan hub and extending away from the fan hub in a direction parallel to the axis of fan rotation. Each fan blade has a radially inner portion, a radially outer portion, and a maximum height measured at a boundary line separating the radially inner portion from the radially outer portion. Each fan blade also includes a leading edge at its innermost radial periphery, and the leading edge, at least at the axially upper one-half section of the radially inner portion, is convexly curved in the shape of a quarter ellipse having a major axis, Mg, substantially parallel to the axis of fan rotation and a minor axis, mh, normal to the major axis Mg. The specific shape of the ellipse is defined by Mg/mh=1.25 to 1.5. Each fan blade also has a substantially axial trailing edge at its outermost radial periphery. The fan also includes a continuous shroud joined to each fan blade at an axially upper section of the radially outer portion thereof and the shroud is concave in cross-section.

The fan orifice used in conjunction with the above-described fan has an axisymmetric leading edge, an axisymmetric trailing edge in downstream air flow relationship with the leading edge, and an entry portion extending from the leading edge to the trailing edge. The entry portion is convex in cross-section and is in the form of a surface produced by rotating a planar line about a coplanar axis of generation that is coincident with the axis of rotation of the fan, the planar line being a generally quarter segment of an ellipse having a major axis, Ma, substantially parallel to the axis of generation and a minor axis, mb, normal to the major axis Ma. The specific shape of the ellipse is defined by Ma/mb= 1.1 to 1.4.

Additionally, the diameter of the entry portion is increased relative to the diameter of the fan itself, to thereby reduce pressure drop through the entry portion due to the pressure of the motor.

The fan constructed as described above allows for easy entry of air into the body of the fan blades, because the upper tips of the fan blades define a wide radial opening between the fan blades and the motor through which air can flow from the inlet of the fan orifice structure. The shape of the fan blades also provides for a more efficient fan, in that there is less of a radial gap between the base region of the fan blades and the outer surface of the motor used to drive the fan.

These and other objects of the present invention will be better understood by reading the following detailed description in combination with the attached drawings of a preferred embodiment of the invention.

DETAILED DESCRIPTION OF THE PREFERRED EMBODIMENT

Figure 1:
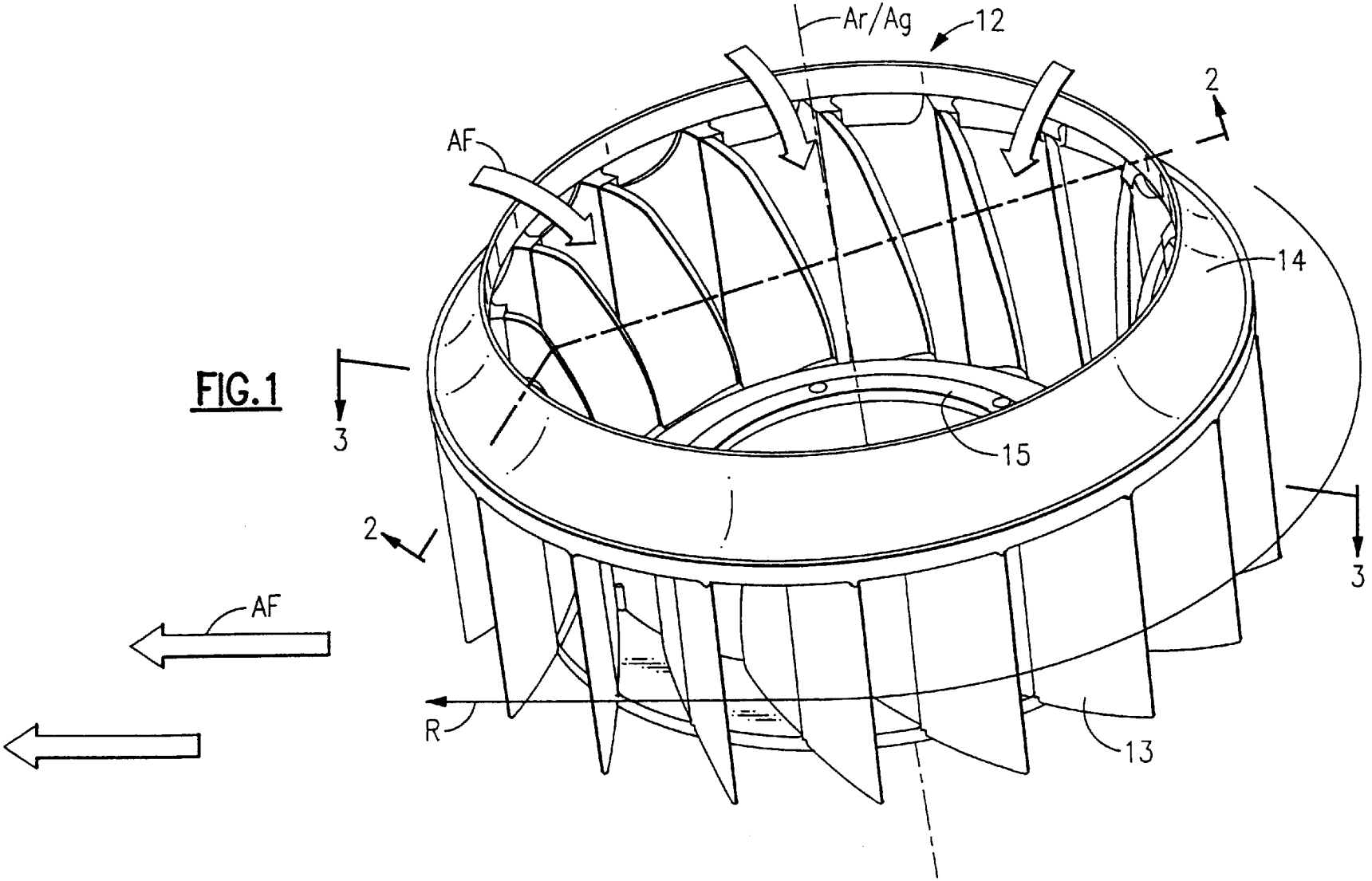
FIG. 1 is a top perspective view of the centrifugal fan of the invention.
Figure 4:
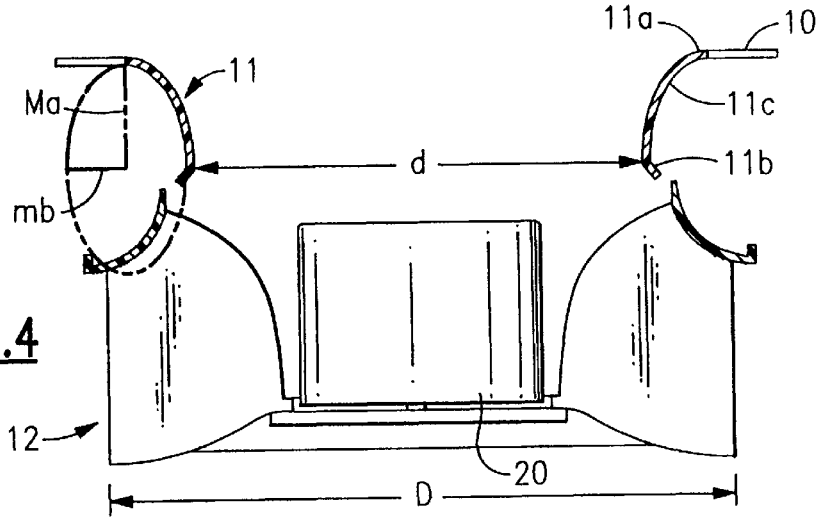
FIG. 4 is a diagram showing the interaction between the fan as shown in FIG. 2 and the fan orifice structure of the invention.
Figure 5:
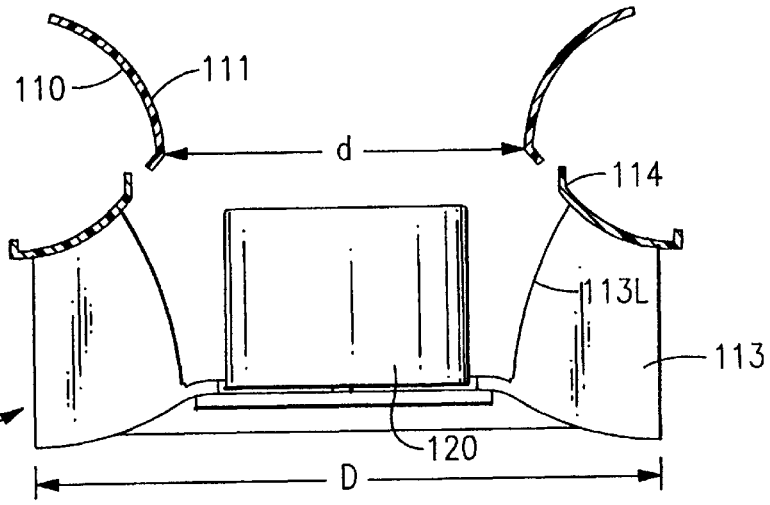
FIG.5 Prior Art
FIG. 5 is a diagram showing a prior art centrifugal fan and fan orifice assembly.

FIG. 1 is a top perspective view of the centrifugal fan of the invention. The fan includes a fan hub 15 lying generally in a plane normal to the axis of fan rotation (Ar) and a central opening for receiving a motor 20 (FIG. 4). While the fan hub is depicted to be frustoconical in cross-section (FIG.2), it can be substantially flat as well, depending largely upon the structure of the particular motor used to drive the fan. A plurality of fan blades 13 of substantially identical construction are spaced circumferentially evenly around fan hub 15 and extend away from the fan hub in a direction parallel to the axis of fan rotation (Ar). A continuous shroud 14 is joined to each fan blade at an axially upper section of a radially outer portion thereof, as described below in more detail. The block arrows AF in FIG. 1 show the direction of air flow through the fan, and the circumferential line arrow R shows the direction of fan rotation about axis Ar.

Figure 2:
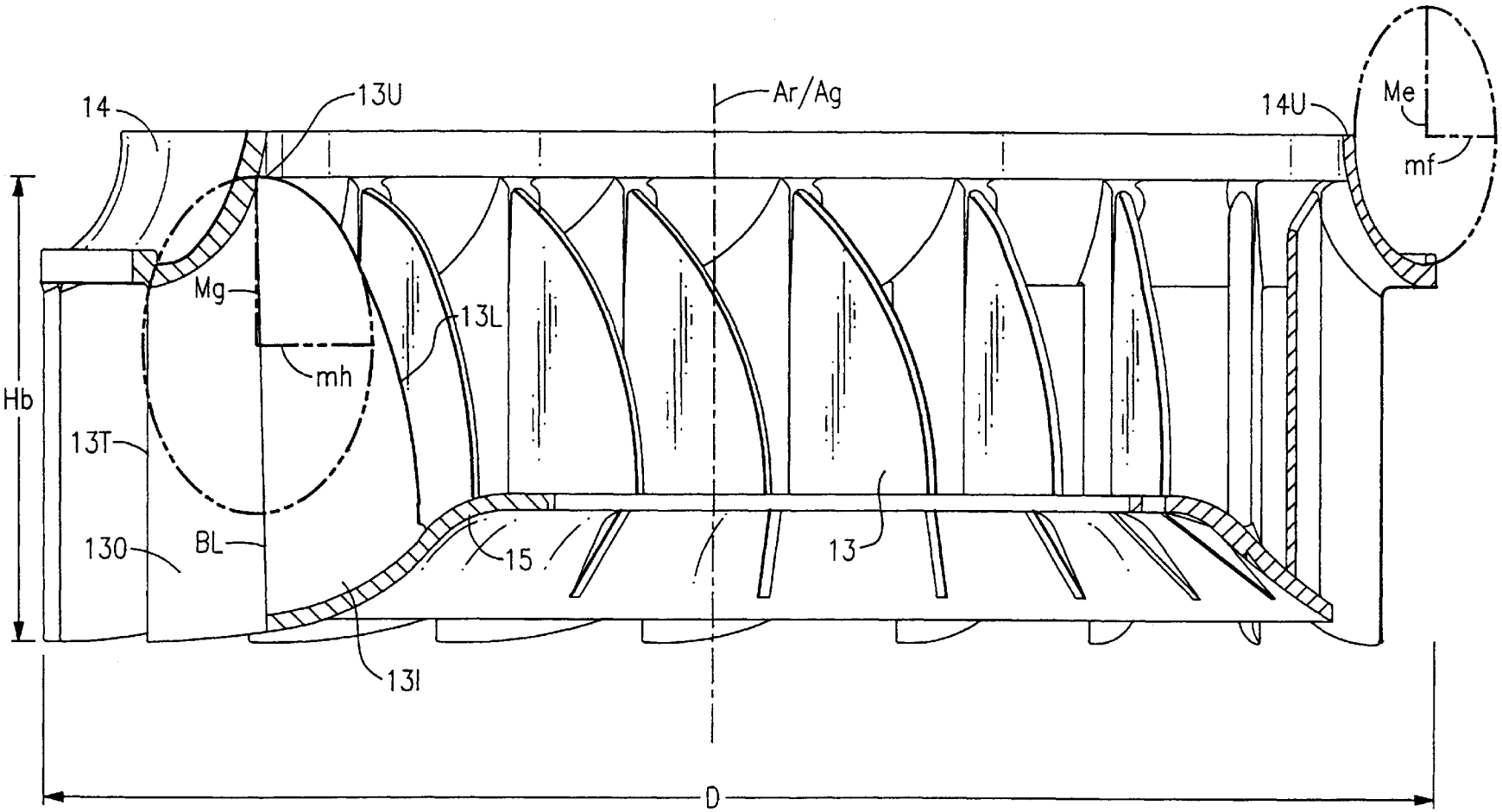
FIG. 2 is a cross-sectional view taken through line 2—2 of FIG. 1.

FIG. 2 is a cross-sectional view taken through line 2—2 of FIG. 1. Line 2—2 passes radially through the fan in the right-hand side of the drawing (to the right of Ar) and passes parallel to the face of one of the fan blades 13 in the right-hand side of the drawing (to the left of Ar). The left-hand side of FIG. 2 shows the shape of the fan blades 13. Each fan blade has a radially inner portion 13I, a radially outer portion 13O, and a maximum height, Hb, measured at a boundary line BL separating radially inner portion 13I from radially outer portion 13O. Each fan blade also has a leading edge 13L at its innermost radial periphery. The leading edge, at least at the axially upper one-half section of radially inner portion 13I, is convexly curved in the shape of a quarter ellipse having a major axis, Mg, substantially parallel to axis Ar and a minor axis, mh, normal to major axis Mg. Preferably, the ellipse has a specific shape defined by Mg/mh=1.25 to 1.5. This allows for a large inlet area while maintaining high blade solidity for good performance. Each fan blade also has a substantially linear trailing edge 13T at its outermost radial periphery.

The boundary line BL separating radially inner portion 13I from radially outer portion 13O extends from the outer diameter of fan hub 15 to the uppermost tip 13U of fan blade 13. The boundary line has a slight draft in that the diameter of the fan at the uppermost tip 13U of fan blade 13 is slightly larger than the outer diameter of fan hub 15. This allows the fan to be made from injected molded plastic using a two-piece mold, as is known in the art.

The right-hand side of FIG. 2 shows the specific shape of shroud 14. It can be seen that shroud 14 is concave in cross-section and has an uppermost tip 14U that extends above the uppermost tip 13U of fan blade 13. The shroud is in the form of a surface produced by rotating a first planar line about a coplanar axis of generation Ag, which is coincident with axis Ar. The first planar line generally is a quarter segment of a first ellipse having a major axis, Me, substantially parallel to axis Ar and a minor axis, mf, normal to major axis Me. Preferably, the ellipse has a specific shape defined by Me/mf=1.2 to 1.5 to insure that the air turns 90° without separation.

FIG. 2 also shows that the fan 12 has an outer diameter, D. It is preferred that major axis, Mg, of fan blade 13 be related to diameter, D, of fan 12 such that Mg/D=0.25 to 0.4. It is also preferred that major axis, Mg, of fan blade 13 be related to maximum height, Hb, of fan blade 13 such that Mg/Hb=0.4 to 0.6. Additionally, it is preferred that minor axis, mf, of shroud 14 be related to diameter D such that mf/D=0.2 to 0.35. All of these parameters reduce flow separation and greatly improve performance.

Figure 3:
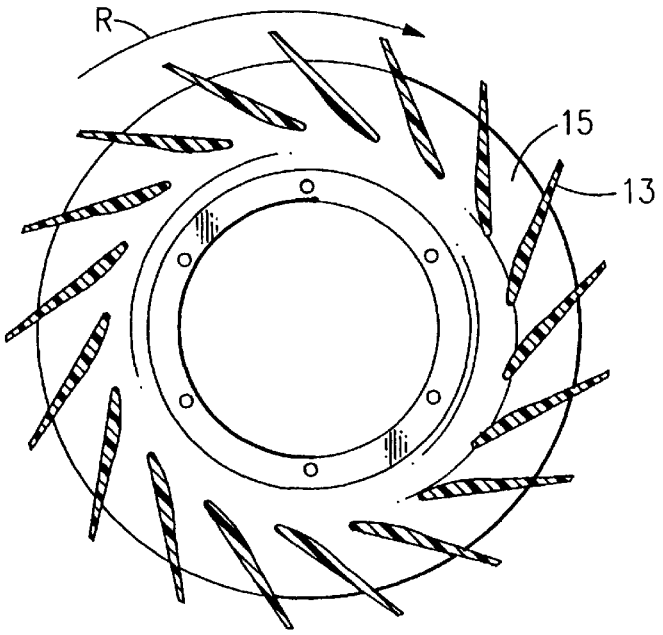
FIG. 3 is a cross-sectional view taken through line 3—3 of FIG. 1.

FIG. 3 is a cross-sectional view taken through line 3—3 of FIG. 1, and shows the orientation of the fan blades along the upper surface of fan hub 15. Each fan blade is substantially planar in shape and is swept in a direction opposite to fan rotation R. Although the fan blades are depicted as having a constant sweep along their entire length, the blades could have a variable sweep angle that changes from leading edge 13L to trailing edge 13T such that trailing edge 13T has less of a rearward sweep than leading edge 13L.

FIG. 4 is a diagram showing the interaction between the fan of the invention and the fan orifice structure of the invention. The fan orifice structure is positioned in upstream flow relationship with fan 12 and has an inlet bulkhead 10 and an entry portion 11. Entry portion 11 has an axisymmetric leading edge 11*a*, an axisymmetric trailing edge 11*b* in downstream air flow relationship with leading edge 11*a*, and a convex portion 11*c* extending from leading edge 11*a* to trailing edge 11*b*. The entry portion 11 has a diameter, d, and it is preferred that d/D=0.75 to 0.9. This allows for a wide inlet opening in the fan assembly and reduces the pressure drop caused by the presence of motor 20.

The convex portion 11*c* of entry portion 11 is in the form of a surface produced by rotating a second planar line about a coplanar axis of generation Ag that is coincident with the axis Ar. The second planar line generally is a quarter segment of a second ellipse having a major axis, Ma, substantially parallel to axis Ar and a minor axis, mb, normal to major axis Ma. Preferably, the ellipse has a specific shape defined by Ma/mb=1.1 to 1.4. It is also preferred that major axis, Ma, of entry portion 11*c* be related to diameter, D, of fan 12 such that Ma/D=0.175 to 0.25. These specific shapes also reduce flow separation and greatly improve performance.

FIG. 4 shows that uppermost tip 14U of shroud 14 axially overlaps trailing edge 11*b* of entry portion 11 to minimize air flow loss at this region. The radial spacing between uppermost tip 14U and trailing edge 11*b* of entry portion 11 should be as small as manufacturing and operating considerations allow.

FIG. 4 also shows that the shape of the axially upper section of the leading edges 13L of fan blades 13 provides a wide radial clearance between the blades and the motor, whereas a relatively small radial clearance is formed between the base region of the fan blades and the motor. The wide radial clearance at the mouth of the fan allows air to enter the body of the fan blades very easily, whereas the narrow radial clearance at the base region of the fan blades maximizes the fan blade surface area available to move air.

The fan can be made of any type of plastic material that typically is used for fan construction. The orifice assembly can also be made of any suitable material.

While the present invention has been described with reference to preferred embodiments thereof, it will be understood by those skilled in the art that various modifications and the like could be made thereto without departing from the spirit and scope of the invention as defined in the following claims.

What is claimed is:

1. A centrifugal flow fan, comprising:

(a) a fan hub lying generally in a plane normal to the axis of fan rotation, and having a central opening for receiving a motor housing;

(b) a plurality of fan blades of substantially identical construction spaced circumferentially evenly around said fan hub and extending away from said fan hub in a direction parallel to the axis of fan rotation, each fan blade having (i) a radially inner portion, (ii) a radially outer portion, (iii) a maximum height, Hb, measured at a boundary line separating said radially inner portion from said radially outer portion, (iv) a leading edge at its innermost radial periphery, the leading edge, at least at the axially upper one-half section of said radially inner portion, being convexly curved in the shape of a quarter ellipse having a major axis, Mg, substantially parallel to the axis of fan rotation and a minor axis, mh, normal to said major axis, wherein Mg/Mh=1.25 to 1.5, and (v) a substantially linear trailing edge at its outermost radial periphery; and (c) a continuous shroud joined to each fan blade at an axially upper section of said radially outer portion thereof, said shroud being concave in cross-section, the fan having an outer diameter, D, Mg/D=0.25 to 0.4 and Mg/Hb=0.4 to 0.6.

2. The centrifugal flow fan of claim 1, wherein said shroud is in the form of a surface produced by rotating a first planar line about a coplanar axis of generation, said first planar line being a generally quarter segment of a first ellipse having a major axis, Me, substantially parallel to the axis of fan rotation and a minor axis, mf, normal to said major axis Me, wherein Me/mf=1.2 to 1.5.

3. The centrifugal flow fan of claim 1, wherein each fan blade, when viewed in a cross-sectional plane taken normal to the axis of fan rotation, is substantially planar and is swept in a direction opposite to fan rotation.

4. A fan and fan orifice assembly, comprising:

a centrifugal flow fan including (a) a fan hub lying generally in a plane normal to the axis of fan rotation, and having a central opening for receiving a motor housing;

(b) a plurality of fan blades of substantially identical construction spaced circumferentially evenly around said fan hub and extending away from said fan hub in a direction parallel to the axis of fan rotation, each fan blade having (i) a radially inner portion, (ii) a radially outer portion, (iii) a maximum height, Hb, measured at a boundary line separating said radially inner portion from said radially outer portion, (iv) a leading edge at its innermost radial periphery, the leading edge, at least at the axially upper one-half section of said radially inner portion, being convexly curved in the shape of a quarter ellipse having a major axis, Mg, substantially parallel to the axis of fan rotation and a minor axis, mh, normal to said major axis Mg, wherein Mg/Mh=1.25 to 1.5, and (v) a substantially linear trailing edge at its outermost radial periphery; and (c) a continuous shroud joined to each fan blade at an axially upper section of said radially outer portion thereof, said shroud being concave in cross-section, the fan having an outer diameter, D, Mg/D=0.25 to 0.4 and Mg/Hb=0.4 to 0.6; and an orifice structure positioned in upstream flow relationship with said fan and having an axisymmetric leading edge, an axisymetric trailing edge in downstream air flow relationship with said leading edge, and a convex entry portion extending from said leading edge to said trailing edge, said entry portion being in the form of a surface produced by rotating a second planar line about a coplanar axis of generation that is coincident with the axis of rotation of said fan, said second planar line being a generally quarter segment of a second ellipse having a major axis, Ma, substantially parallel to said axis of generation and a minor axis, mb, normal to said major axis.

5. The fan and fan orifice assembly of claim 4, wherein Mg/Hb=0.4 to 0.6.

6. The fan and fan orifice assembly of claim 4, wherein said shroud is in the form of a surface produced by rotating a first planar line about a coplanar axis of generation, said first planar line being a generally quarter segment of a first ellipse having a major axis, Me, substantially parallel to the axis of fan rotation and a minor axis, mf, normal to said major axis Me, wherein Me/mf=1.2 to 1.5.

7. The fan and fan orifice assembly of claim 4, wherein each fan blade, when viewed in a cross-sectional plane taken normal to the axis of fan rotation, is substantially planar and is swept in a direction opposite to fan rotation.

8. The fan and fan orifice assembly of claim 4, wherein the fan has an outer diameter, D, and Ma/D=0.175 to 0.25.

9. The fan and fan orifice assembly of claim 4, wherein the fan has an outer diameter, D, and mf/D=0.2 to 0.35.

10. The fan and fan orifice assembly of claim 4, wherein the fan has an outer diameter, D, the entry portion has a diameter, d, and d/D=0.75 to 0.9.

* * * * *